United States Patent [19]

Saier et al.

[11] 4,179,911

[45] Dec. 25, 1979

[54] Y AND T-FINNED TUBES AND METHODS AND APPARATUS FOR THEIR MAKING

[75] Inventors: Manfred Saier, Wullenstetten; Hans-Werner Kästner, Vöhringen; Robert Klöckler, Tiefenbach, all of Fed. Rep. of Germany

[73] Assignee: Wieland-Werke Aktiengesellschaft, Fed. Rep. of Germany

[21] Appl. No.: 922,888

[22] Filed: Jul. 7, 1978

[30] Foreign Application Priority Data

| | | | |
|---|---|---|---|
| Aug. 9, 1977 | [DE] | Fed. Rep. of Germany | 2735762 |
| Dec. 28, 1977 | [DE] | Fed. Rep. of Germany | 2758526 |
| Dec. 28, 1977 | [DE] | Fed. Rep. of Germany | 2758527 |

[51] Int. Cl.[2] ..... B21H 3/00; B21D 53/06

[52] U.S. Cl. ..... 72/78; 72/98; 29/157.3 AH; 165/184

[58] Field of Search ..... 72/68, 71, 78, 98; 165/133, 181, 183, 184, 185; 29/157.3 R, 157.3 A, 157.3 AH, 157.3 B

[56] References Cited

U.S. PATENT DOCUMENTS

| | | | |
|---|---|---|---|
| 3,326,283 | 6/1967 | Ware | 165/184 |
| 3,383,892 | 5/1968 | Brothen | 29/157.3 AH |
| 3,753,364 | 8/1973 | Runyan et al. | 29/157.3 R |
| 3,768,290 | 10/1973 | Zatell | 29/157.3 B |
| 3,887,004 | 6/1975 | Beck | 29/157.3 A |
| 4,004,441 | 1/1977 | Laszak | 165/133 |

*Primary Examiner*—Lowell A. Larson

*Attorney, Agent, or Firm*—Ladas, Parry, Von Gehr, Goldsmith & Deschamps

[57] ABSTRACT

This invention concerns finned tubes for use in heat exchanging whereby the fins have a generally T or Y shape. There is disclosed process and apparatus for making these Y and T-finned tubes whereby a smooth tube is subjected to conventional rolling process with the ends of the fins being subsequently notched into Y-fins and, if desired, subsequently flattened into T-fins. According to other embodiments of the invention the T-fins are constructed by an apparatus including an oblique surface which contacts the conventionally constructed fins causing the fins to be flattened into a general T shape.

24 Claims, 14 Drawing Figures

Y AND T-FINNED TUBES AND METHODS AND APPARATUS FOR THEIR MAKING

BACKGROUND OF THE INVENTION

1. Field of the Invention

This invention concerns tubes used in heat exchangers which are finned in order to increase their heat exchanging properties as well as a method and apparatus for rolling finned tubes and subsequently working the fins to obtain a Y or T shape.

2. Description of the Prior Art

Finned tubes are known generally in the art. For example, German Offenlegungschrift No. 1501656 shows a finned tube in which the fins have indentations provided in the fins at their outer circumference. Such tubes are beset with difficulties in storage and transport as well as in installation of the tube into tube plates and into support washers which are used in mounting the tubes in heat exchangers. Furthermore, the use of such tubes in tube bundle type evaporators can be troublesome since the crevices between adjoining fins of the tubes which are located in relatively high positions of the evaporators tend to collect bubbles rising from below. These bubbles lodge in these crevices and prevent an optimum heat exchange operation. The rising bubbles are able to enter into the relatively wide openings in the crevices between adjoining indentations and thereby prevent the evaporation surfaces from making optimum contact with the liquid.

U.S. Pat. No. 3,299,949 shows a power vacuum tube having longitudinal T-formed fins used for cooling. These tubes must, however, be arranged in a perpendicular fashion in order to utilize the so-called "thermo syphon effect". A utilization of this principal in regard to evaporators consisting of bundles of tubes is not possible since in regard to these evaporators the tubes must be arranged horizontally.

BRIEF SUMMARY OF THE INVENTION

According to the invention there are provided Y and T-finned tubes wherein the mechanical characteristics, the heat exchanging characteristics and the ease of handling characteristics are improved. The Y and T-fins circle the tube in a continuous unbroken fashion with the gap between adjacent fins being narrowed and being uniform about the circumference of the tube.

According to a first embodiment of the invention, there is provided method and apparatus for fabricating the inventive T-tube; according to a second embodiment of the invention, this first method and apparatus is modified so as to fabricate an inventive Y-finned tube; in a third and fourth embodiment of the invention, there are provided two related methods and apparatus for constructing T-finned tubes according to which the fins contact an oblique surface and are thereby flattened.

The finned tubes constructed in accordance with this invention present substantial advantages over state of the art finned tubes, in regard to mechanical characteristics and ease of handling characteristics.

Both the Y and T-tubes constructed in accordance with the teachings of this invention include Y or T-fins which encircle the tube in a continuous unbroken fashion with the ends of the Y or T formed fins approaching each other and thereby forming a relatively narrow gap between the top of adjacent fins with a relatively wider chamber between adjacent fins lying below this narrow gap.

In this manner, particularly in the T-fins, one obtains a tube with a seemingly smooth circumferential surface on which tubes are easily stacked, one on the other, are easily transported, and are easier to insert into tube plates or other fixtures. The difference between the outer diameter of the un-finned ends and the fin diameter is a multiple larger than in the case of normal finned tubes.

Finned tubes of this sort have important further advantages over known tubes.

The outer ends of the fins, which, in the case of normal finned tubes, are partially rough and to some extent include cracks and splits, are, in the T-tubes constructed according to the invention, solid and smoothly machined, the tubes will have fewer indentations on their surface and will therefore be better able to withstand mechanical alternating stress. A propagation of cracks in the tube will be thereby limited.

The heat exchange function according to the disclosed T and Y tubes is improved in regard to the evaporation process since the evaporation of fluids largely takes place in the hollow chambers between the T or Y formed fins. The evaporated fluid will be continually replaced by the fluid which enters the crevice between two adjoining fins. The formation of bubbles will not be interupted since small bubbles will be able to detach themselves continuously; there will always remain bubbles in the hollow chambers so that new bubbles can be continuously formed and the nucleation energy will remain minimal (see German Pat. No. 1551542).

Particularly in the case when tubes constructed in accordance with this invention are used with tube bundle type evaporators, rising bubbles will be prevented from entering into the crevices between the fins of the tubes which are placed in relatively higher position. These rising expanding bubbles will rather roll past these higher placed tubes so that the surfaces of these tubes will remain completely usable for evaporation purposes.

A discussion of the thermic advantages of the invention will be presented in connection with the below described particular embodiment.

According to the invention, the distance between adjacent fins in the radial direction proceeding from the tube wall outwards first increases and then this distance between the fins decreases as one approaches the ends of the fins. This increase and decrease in the distance between adjacent fins occurs preferably in a continual manner.

The T or Y-fins can be constructed so as to be disposed in a ring-like fashion about the circumference of the tube or, according to a further embodiment of the invention, the fins run in a single or multiple threaded fashion and in a spiral or helical fashion about the circumference of the tube. It is well known in the art that one can obtain a multiple threaded arrangement by increasing the angle, by integral multiples, between the rolling tool and the tube upon which the threading operation is being carried out. In order to obtain good heat exchange characteristics, it is recommended that there be arranged at least two fins per centimeter, preferably two to twenty fins per centimeter, with the upper crevice width being at least 0.1 mm and preferably 0.1 to 1.0 mm.

It is also an object of this invention to provide processes for manufacturing the T and Y tubes according to the invention.

The usual rolling process for forming finned tubes is shown in U.S. Pat. No. 3,327,512 in which the fin material is obtained by means of displacement of the material making up the tube wall, which material is displaced in an outward direction by means of a rolling process and that the tube, by means of the rolling energy, is either both placed in rotation and pushed or only pushed according to the formed fins whereby fins with increasing height are formed from the otherwise unformed smooth tube wall.

According to one embodiment of the invention the ends of the fins after formation are smoothed by means of radial pressure so that the ends of the smoothed fins appear to lie flat along the surface of an imaginary cylinder which is co-axial with the tube middle axis. The ends of the fins, after being smoothed, are notched in the circumferential direction of the tube, then bent to the side, to form Y-fins.

According to another embodiment of the invention, there is included an additional step whereby the Y-formed fins are finally forced into a T-form by means of inwardly directed radial pressure.

As mentioned, the conventionally formed fins are smoothed preparatory to the notching operation; a smoothing of approximately 5 to 15% of the original height of the fins is preferred.

The flattening operation which is used in the formation of T-fins functions also as a tube straightening operation in that the flattening operation causes the tube to become exceptionally straight. Further, as mentioned, the known dangers of injury from sharp and raw fin edges, which occur when one works with such tubes, will be substantially reduced.

It is well-known that the inner surface of a tube will become uneven and wavy when the tube is subjected to a rolling operation, this waviness increasing as the strength of the tube walls decreases. This waviness which is caused by the radial pressures during the rolling of the fins, will, by means of the flattening operation, be decreased. One achieves therefore an inner surface of the tube which will have substantially less impediment to the flow of fluids contained therein.

Pursuant to the above discussed process for making Y and T-fins, any pronounced distortion in the shape of the base of the fins is avoided. The area between the fins will contain similarly shaped hollow chambers and the crevice width between two fins will be relatively constant. The hollow chamber between two fins as well as the crevice gaps will be variable in a defined and continuous manner.

The apparatus for carrying out the above discussed process can be constructed so that the tube will rotate relative to a fixed rolling head or so that the rolling head will rotate about a fixed tube, that is, a tube which moves only in the axial direction and does not rotate.

An apparatus having a rotating tube is shown in U.S. Pat. No. 3,327,512. There is shown a finned tubing wherein there are at least two radially adjustable tool holders arranged at the circumference of the tube in staggered relation to each other and located in a fixed rolling head, each tool holder including a driven rolling tool including a plurality of rolling discs, the rolling tool having an axis which is at a skew angle to the tube axis.

According to the above discussed embodiments of the invention, this said apparatus is modified so that in at least one rolling tool holder a smoothing roller is included and follows the rolling tool. There is then arranged a notching means in at least one rolling tool holder following the smoothing roller. The notching means is displaced from the rolling tool at least by the width of the smoothing roller and forms Y-fins. In the case where T-fins are desired there is also arranged a flattening roller, the distance of the flattening roller from the rolling tool being at least the sum of the thicknesses of the smoothing roller and the notching roller.

In the case of a revolving rolling head apparatus, one would similarly provide at least two radially adjustable tool holders arranged at the circumference of the tube in staggered relation to each other and located in a rolling head, again each tool holder including a rolling tool including a plurality of rolling discs, the rolling tool having an axis which is at a skew angle to the tube axis whereby the rolling head is rotatably mounted and drivable in the circumference direction of the tube which will not itself rotate.

Such an apparatus, i.e; a revolving head apparatus, modified according to the invention would have in at least one tool holder a cylindrical smoothing roller following the rolling tool and a notching roller arranged at a distance from the rolling tool of at least the thickness of the smoothing roller for forming Y-fins. A clamping holder for the tube is also provided. In the case where T-fins are desired, there is also arranged a flattening roller whose distance from the rolling tool is at least the sum of the thicknesses of the smoothing roller and the notching roller and, in addition, a clamping holder for the tube is also provided.

The clamping holder carries out the axial movement of the tube whereby it is either pulled by the forward portion of the tube or is moved by means of its own driving force.

In order to assure that the centers of the upper surfaces of the fins are contacted by the notching roller, it is advantageous to arrange a distance disc between the rolling tool and the smoothing roller. The thickness of the distance disc is approximately half that of the distance between adjacent fins. The smoothing roller and the cylindrical flattening roller each have a thickness which is approximately that of the distance between adjacent fins.

The Y-formed fins are constructed with the notching rollers arranged around the tube as follows: Proceeding in the direction of rotation of the tube, the first notching roller will have a notching angle between 60° and 100°, the second notching roller will have a notching angle between 80° and 130°. A third notching roller is not necessary in order to form the Y-shaped fins and if T-fins are desired, in the place of a third notching roller, one can include a flattening roller, the diameter of which should correspond to that of the first notching roller.

In order to assure that the notching roller will contact the smoothed fins directly in the middle of the upper surface of the fins it is preferable to provide a correction disc between the cylindrical roller and the notching roller.

According to a third embodiment of the invention, T-fins are constructed by first forming conventional fins by means of a rolling tool mounted at the circumference of the tube. There is provided a flattening means including a hull in the shape of a doughnut following the rolling tool. The hull has a surface oblique to the formed fins. As the tube is moved in the longitudinal direction the fins contact the oblique surface of the hull and are thereby flattened into a generally T-shape. The hull is arranged so that its axis runs parallel to that of the tube, but is displaced somewhat.

According to a fourth embodiment, T-fins are formed by providing a rolling tool located at the circumference of the tube. Following the rolling tool and co-axial therewith there is arranged a generally conical form having a surface which is oblique to the formed fins. The fins contact the conical form and are thereby flattened.

These embodiments will be described in greater detail in connection with the following figures.

DETAILED DESCRIPTION OF THE DRAWINGS

Figure 1:
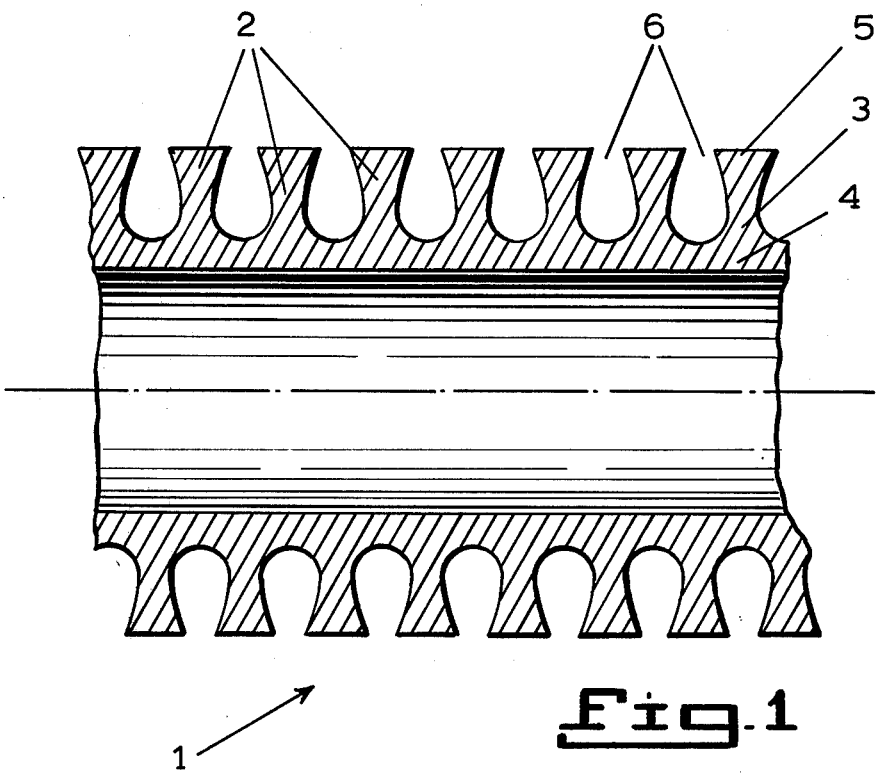
FIG. 1 shows a longitudinal section of the inventive T-finned tube.
Figure 2:
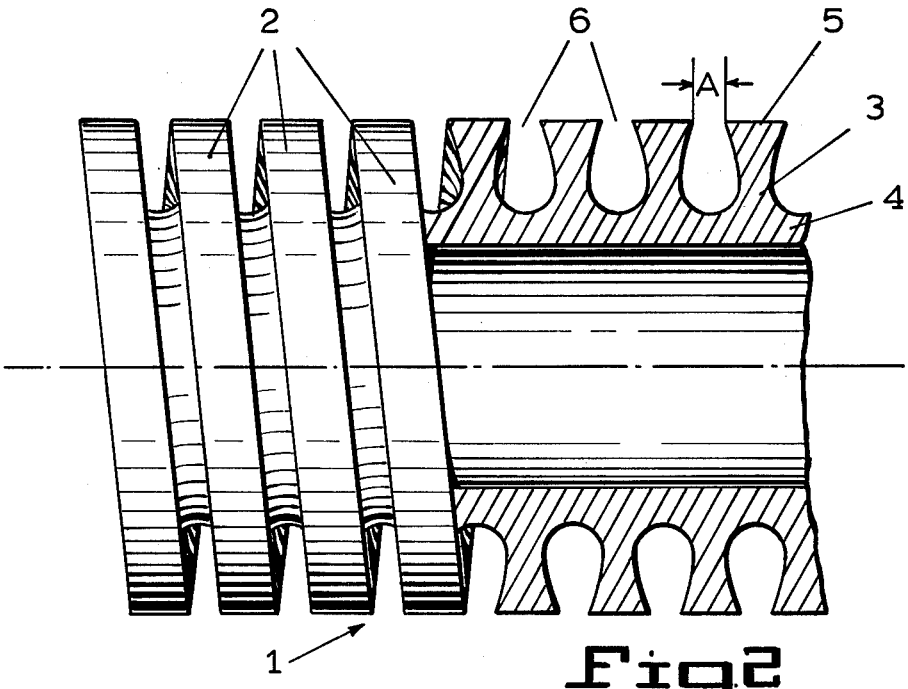
FIG. 2 shows a partial section of the T-finned tube.

Referring to FIGS. 1 and 2 there is shown a finned tube 1 in longitudinal section (FIG. 1) and partial section (FIG. 2). The T-formed fins 2 run circumferentially in a helical or spiral fashion. The base 3 of the fins 2 is extending in the radial direction from the tube wall 4 while the fin ends 5 are forced into a T-form so that a narrowed crevice 6 is formed (see the upper crevice width A in FIG. 2). The distance between adjacent fins 2 varies continuously forming an essentially rounded hollow chamber between adjacent fins 2. The fins can be formed to run in a ring like fashion instead of helical fashion about the tube.

Figure 3:
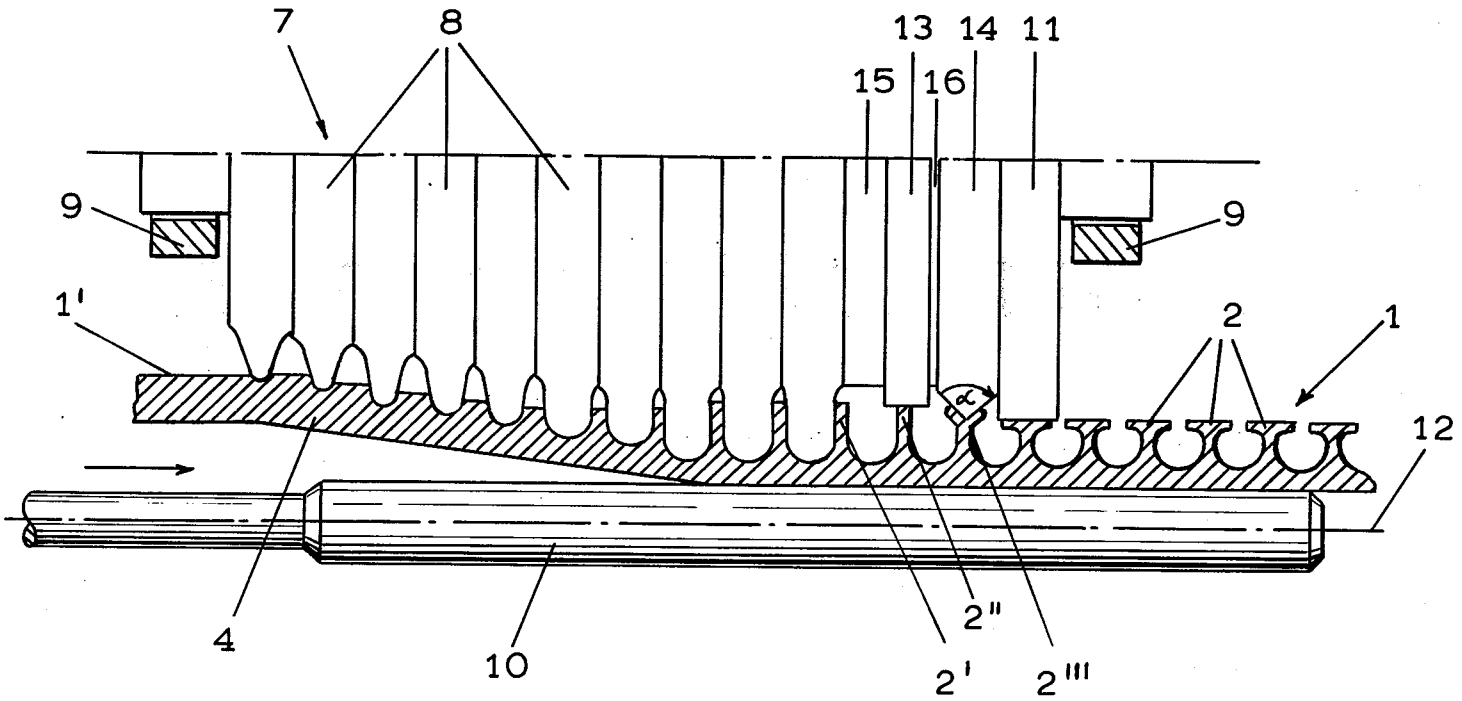
FIG. 3 shows an apparatus for the manufacture of a T-finned tube from a Y-finned tube.

The apparatus according to FIG. 3 for constructing a T-finned tube 1 from a Y-finned tube can be used with a rotating tube or with a rotating roller head and non-rotating tube.

The functioning of the apparatus in conjunction with a rotating tube will be now explained.

Figure 4:
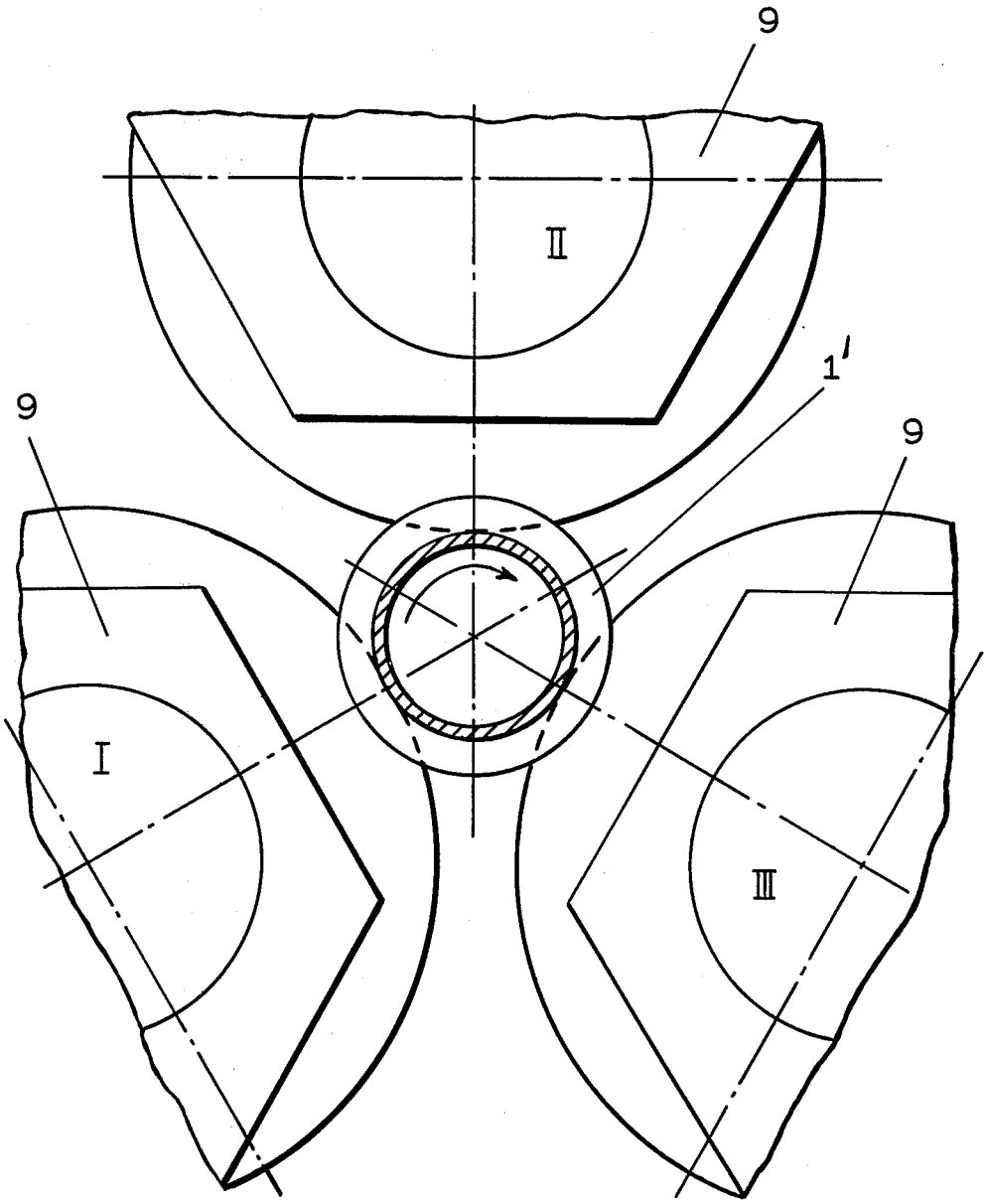
FIG. 4 shows a schematic representation of the tool holders used in FIG. 3.

Referring to the apparatus of FIG. 3, there is shown a rolling tool 7, a cylindrical smoothing roller 13, a notching roller 14, and a cylindrical flattening roller 11, integrated into a tool holder 9 (FIG. 3 shows only a single tool holder 9). FIG. 4 shows two further tool holders 9, each displaced 120° from each other about the circumference of the tube 1. The tool holders 9 are radially adjustable. One could use, for example, 4 or 6 tool holders 9. The tool holders 9 are arranged in a fixed rolling head which is not shown in the figures.

The smooth tube 1' will be placed in rotation by the rolling tools 7 which are arranged at the circumference of the tube 1'. The axis of the rolling tools 7 will be at a skew angle to the axis of the tube. The arrow shown in FIG. 4 indicates the direction of circumferential movement of tube 1'.

The rolling tools 7 consist of a plurality of rolling discs 8 which are arranged adjacent each other in a known manner.

The centrally arranged rolling tools 7 forms the fins 2' in a known manner from the tube wall 4 which is supported by mandrel 10. In this manner there is first performed a reduction in the diameter of the tube along the leading portion of the tube. In the middle section of the tube there will then follow the machining of the spiral formed circumferentially running fins 2'.

Figure 5:
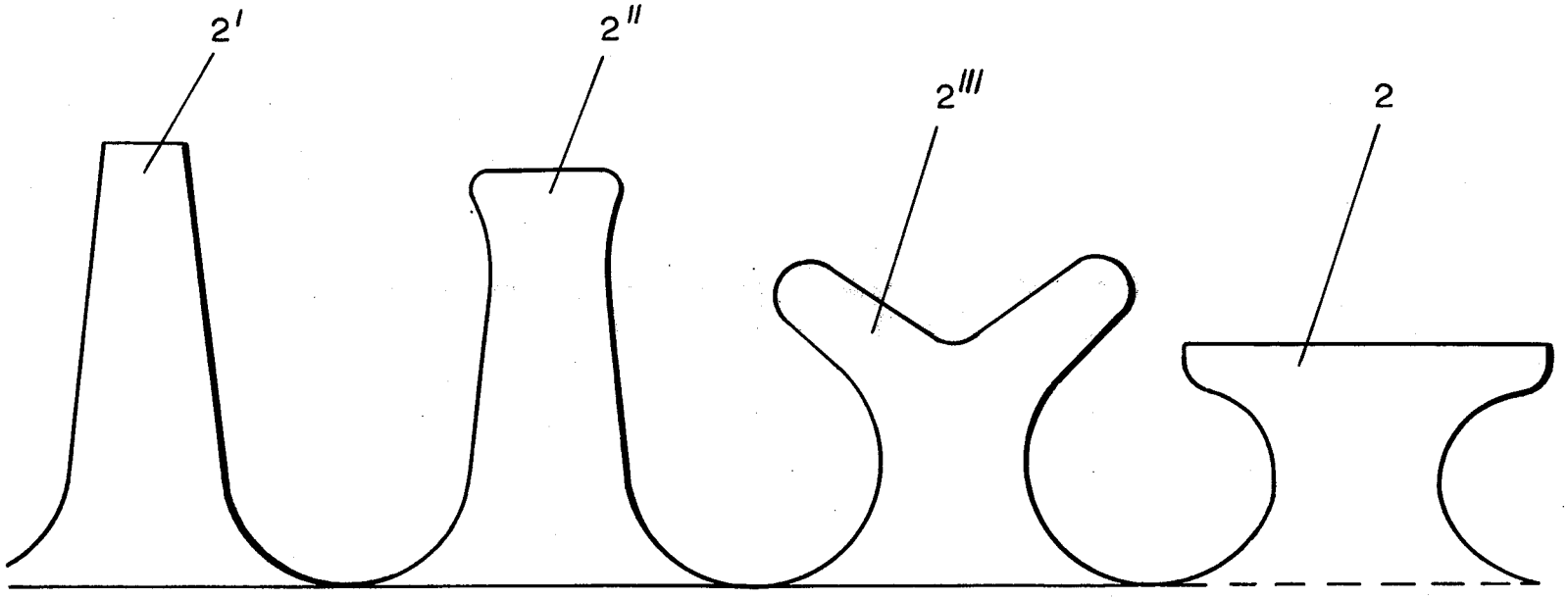
FIG. 5 depicts the formation of the fins produced by the apparatus of FIGS. 3 and 4.

By means of the smoothing roller 13, the ends of the fins 2' will be smoothed so that the end surfaces of the smoothed fins 2'' will lie along the inner surface of an imaginary cylindrical surface which would be co-axial with the middle axis 12 of of the tube. The subsequently arranged notching roller 14 indents the fins 2'' in the circumferential direction of the tube 1 and simultaneously bends the notched portions to the side so that Y-formed fins 2''' result. These Y-formed fins are then flattened by flattening roller 11 into T-formed fins 2 (see also FIG. 5).

The following preferred embodiment dimensions are given which would correspond to the working of a smooth tube having 19 mm outer diameter and a 1.45 mm wall thickness.

First of all, one would form the fins 2' by means of approximately 25 rolling discs 8 (this number of discs not being shown in the drawings for ease of understanding of drawings). The diameter of the rolling discs 8 is approximately 50 mm and increases in the direction of the arrow as depicted in FIG. 3. Corresponding to the desired fin spacing of 1.35 mm, the rolling discs are approximately 1.3 mm thick. As the diameter of the rolling discs increases, the radius of the apex of the rolling discs 8 will become larger and the flank angle smaller as is depicted in FIG. 3.

Between the last rolling disc and the cylindrical smoothing roller 13, there is arranged a distance disc 15 having a thickness of 0.7 mm. The thickness of the distance disc 15 corresponds therefore approximately to one half the fin spacing 1.35 mm. The smoothing roller 13 has a diameter which corresponds to that of the first rolling disc and has a thickness of 1.3 mm.

Following the smoothing roller 13 there is arranged a notching roller 14 having a thickness of 1.3 mm. According to the arrangement of FIG. 4, the notching rollers 14 in the tool holders 9 (I II) have an increasing diameter which is a few tenths of a millimeter larger than the diameter of the smoothing roller 13. The tool holder 9 indicated in FIG. 4 will hold, as mentioned previously, not a third notching roller, but rather a flattening roller in the case where T-fins are desired; for Y-fins, there would be no flattening roller. The angle $\alpha$ (FIG. 3) of the first notching roller 14 is 90° while the angle $\alpha$ (FIG. 3) of the second notching roller 14 is 120°.

In order that the notching roller 14 contacts the ends of the fins which have been smoothed by smoothing roller 13 in the middle of the fins' upper surface there is arranged between the smoothing roller 13 and the notching roller 14 a correction disc 16 which should have a thickness of a few tenths of a millimeter.

Following the notching roller 14 is arranged a flattening roller 11 which has a diameter corresponding to the diameter of the notching roller 14 and which has a thickness of 1.3 mm. There is no correction disc arranged between the flattening roller 11 and the notching roller 14.

The material used for the rolling discs 8, the smoothing roller 13, the notching roller 14, and the flattening roller 11 is high alloy tool steel.

The radially adjustable rolling tools 7 are operated with a starting rotation of 150–400 revolutions per minute and the end speed rotation will be approximately three to four times higher.

In order to vary the crevice width A between the ends of the fins (FIG. 2) either the diameter and/or the notching angle $\alpha$ of the notching roller 14 can be varied for a given radial adjustment of the tool holders 9.

Starting with a smooth tube of Sf-Cu having a 19 mm outer diameter and a wall thickness of 1.45 mm standard finned tubes were made with the device of FIGS. 3 and 4 having the following dimensions: fin spacing—1.35 mm, fin height—1.5 mm, inner diameter—14 mm. The apparatus according to FIGS. 3 and 4 was also used to construct T-finned tubing according to the invention. The dimensions of the two tubes, standard finned and T-finned, are given in the following table.

TABLE I

| | | Standard finned tube | | T-Finned |
|---|---|---|---|---|
| Fin spacing | mm | | 1.35 | |
| Fins per inch | | | 19 | |
| Fins per meter | | | 740 | |
| Fin diameter a | mm | 18.9 | | 18.1 |
| Outer diameter | mm | | 15.9 | |
| Inner diameter | mm | | 14.1 | |
| Fin Height | mm | 1.5 | | 1.1 |
| Crevice width A | mm | ~1.0 | | 0.25 |
| Finned length | mm | | 1975 | |
| Outer diameter of un-finned end b | mm | | 19.2 -0.2 | |
| b–a | mm | 0.3–0.2 | | 1.1–0.3 |
| Conditions | | | | |
| Refrigerant | | | R12 | |
| Evaporation temperature | °C. | | 2.0 | |
| Middle log temperature interval | K | | 8.1 | |

Both tubes were measured in flood evaporation operation (water in tube, refrigerant outside of the tube) the conditions being set forth in the table. The measurements were taken so that at a constant evaporation temperature the logrithmic temperature interval was held constant.

Figure 6:
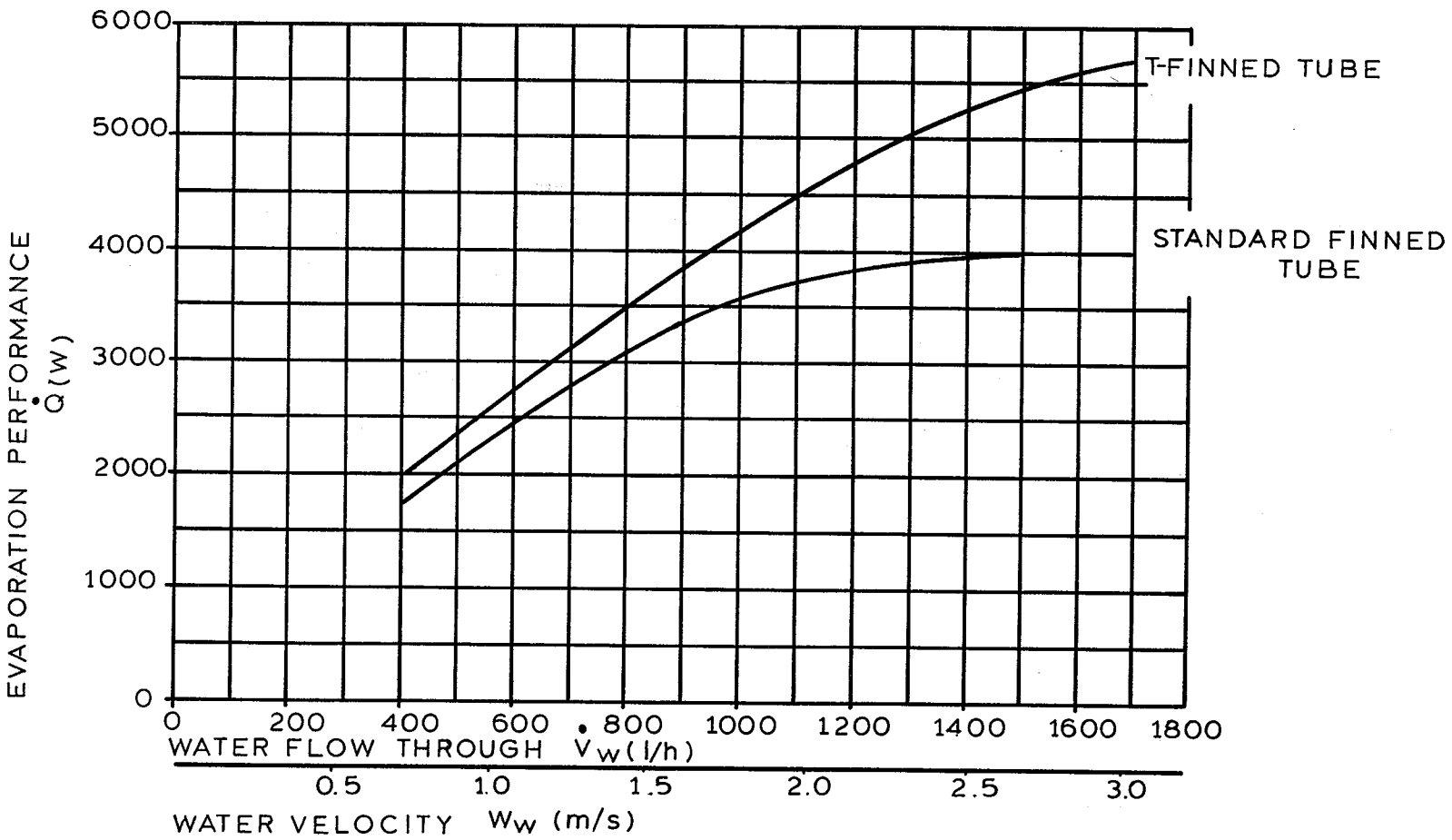
FIG. 6 shows the evaporation performance as a function of the water flow-through in the case of a standard finned tube (fin separation 1.35 mm; fin diameter 18.9 mm; fin height 1.5 mm; inner diameter 14.1 mm) and this evaporation performance in the case of a corresponding T-finned tube constructed according to the invention.
Figure 7:
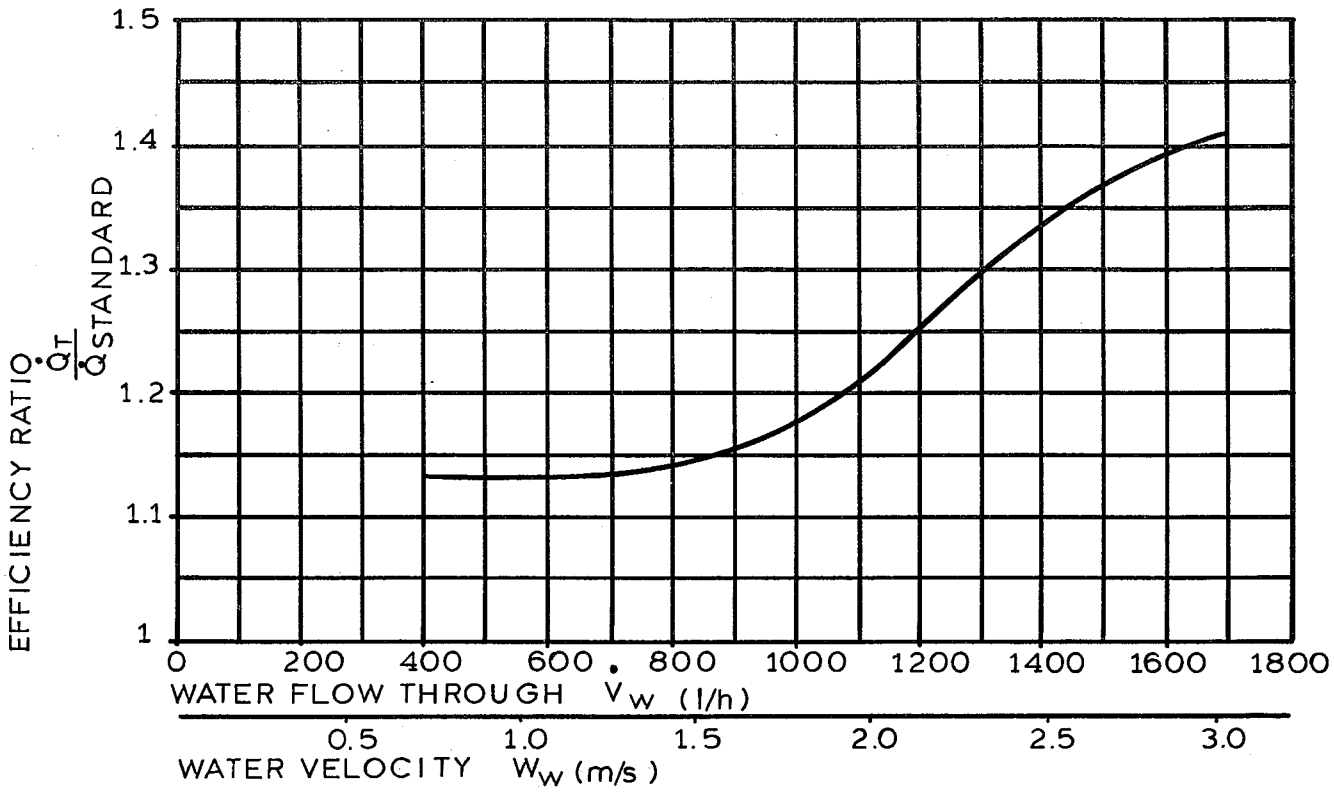
FIG. 7 shows the resulting comparative performance of the two tubes.

FIG. 6 shows the evaporation performance $\dot{Q}$ (W) as a function of the water flow through rate $\dot{V}w$ (1/h) and the water velocity Ww (m/s). FIG. 7 shows the resulting performance relationship $\dot{Q}T$ - finned tube/$\dot{Q}$ standard finned tube.

From this one can obtain the improvement in performance of the T-finned tube in regard to the standard finned tube for the technically important area of water velocity from 1.5 to 2.5 m/s.

TABLE 2

| Ww m/s | 1.5 | 2.0 | 2.5 |
|---|---|---|---|
| Performance Improvement (%) | 14 | 21.5 | 34 |

The following comparisons with the standard finned tube and the T-finned tube are set forth in Table 3.

TABLE 3

| | | Water speed in Tube | | |
|---|---|---|---|---|
| Comparison 1 | m/s | 1.5 | 2.0 | 2.5 |
| Same tube length and same water speed: | | | | |
| Performance | % | 114 | 122 | 134 |
| Pressure fall on water side | % | 100 | 100 | 100 |
| Comparison 2 | | | | |
| Same performance and same water speed: | | | | |
| Tube length | % | 88 | 82 | 75 |
| Pressure fall on water side | % | 88 | 82 | 75 |
| Comparison 3 | | | | |
| Same performance and same pressure fall on water side: | | | | |
| Water speed | % | 107 | 114 | 120 |
| Tube length | % | 86 | 77 | 71 |

The advantage of the T-finned tube in regard to performance is therefore that tube type bundle apparatus with the same construction as before (number of tubes, length of tubes, jacket diameter) have a higher performance with the same pressure fall on the water side (identical pumps) (Comparison 1)

apparatus can be now constructed shorter than previously and the pressure fall on the water side can be held smaller (Comparison 2)

in regard to new constructions (different number of tubes, length of tubes pass number) the cost for the tubing can be kept minimum (Comparison 3). It should also be noted that besides savings in regard to the tubes themselves there will also be a reduction in the costs necessary for assembling the apparatus.

The T-finned tubes are also easier to build into the apparatus, since, as one can see from Table 1, the difference between the outer diameter b of the unfinned ends and the fin diameter a is approximately 4 to 6 times larger as in the case of the standard finned tubes.

Figure 8:
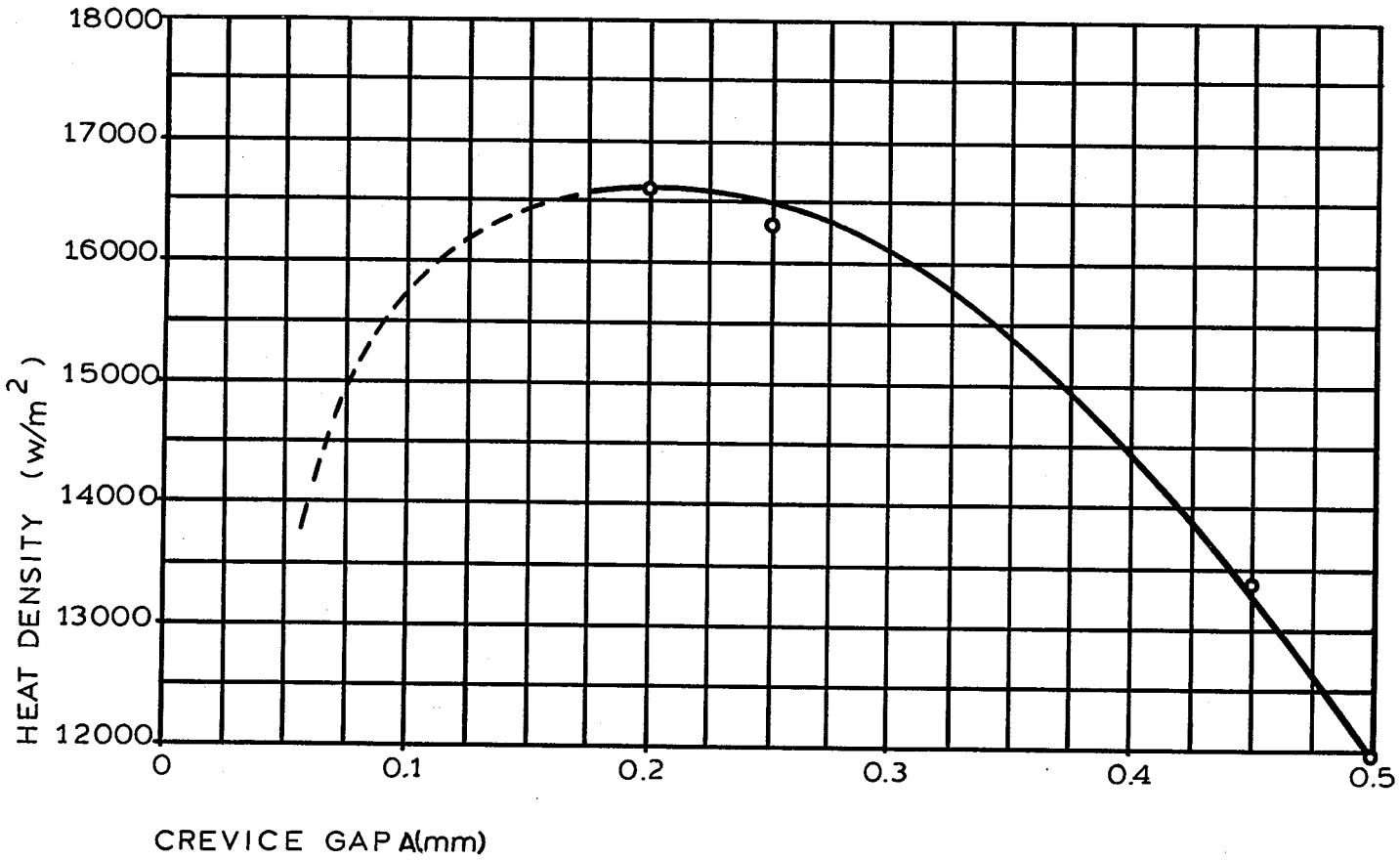
FIG. 8 shows the heat flow density as a function of various crevice widths of the T-tubes.

FIG. 8 shows the heat density as a function of various crevice widths A between adjoining fins. The optimum crevice width A is approximately 0.2 mm. The curve shown in FIG. 8 below the maximum point of approximately 0.2 mm is shown as a dashed line since in the case of relatively small crevice widths A, the heat exchange falls sharply.

As mentioned, the above described process and apparatus for constructing a T-finned tube can be used for constructing Y-finned tube which will have thermic advantages of the T-tube although the Y-tube will not have the smooth outer surface of the T-tube. The Y-tube will have an additional advantage of being easier to construct than the T-tube since, as will be seen, the process for making the Y-tube is at least one step shorter than the process for making the T-tube.

Figure 9:
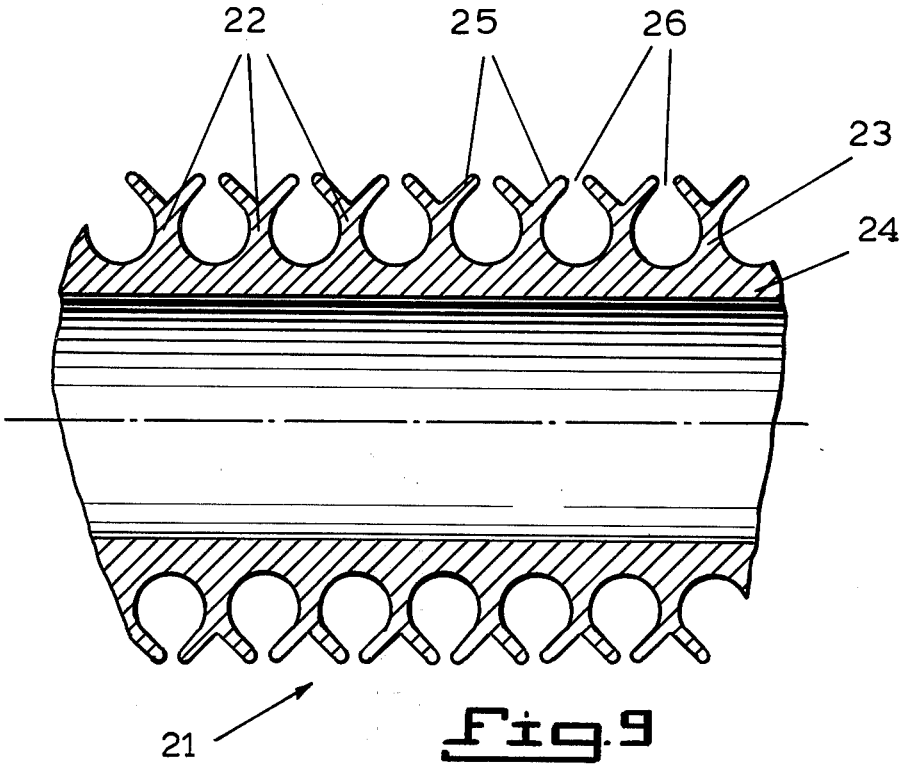
FIG. 9 shows a longitudinal section of the inventive Y-finned tube.

FIG. 9 shows a Y-finned tube 21 having fins 22 running circumferentially in a helical or spiral fashion although, as was the case in regard to the T-tube, ring formed fins could also be formed.

As with the T-tube of FIG. 1, the bases 23 of the fins 22 are displaced in the radial direction from the tube wall 24 while the fin ends 25 are forced into a Y-form so that a narrowed crevice 6 is formed.

Figure 10:
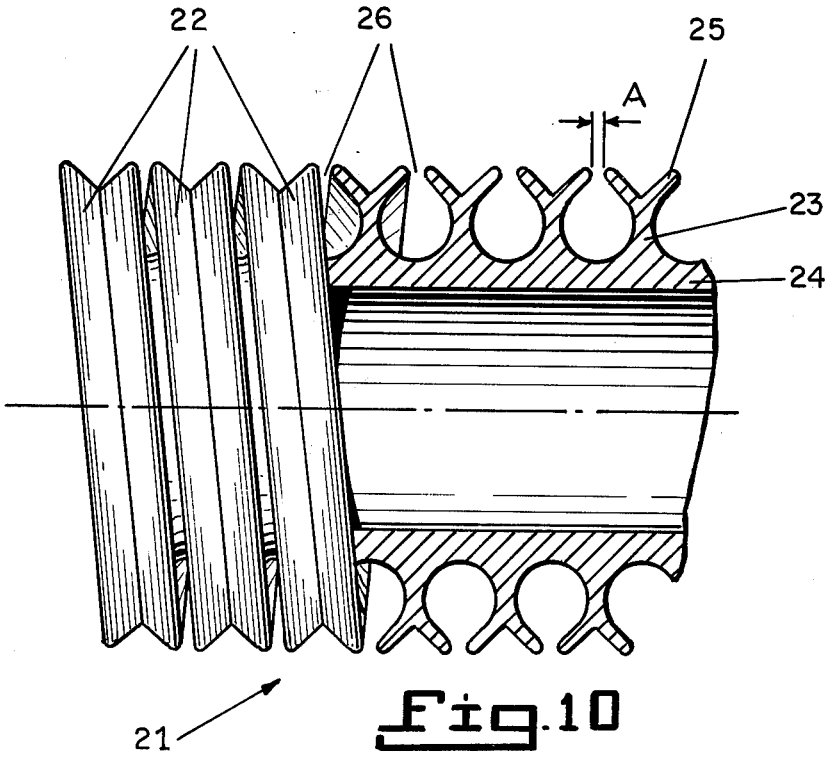
FIG. 10 shows a partial section of the Y-tube of FIG. 9.

FIG. 10 shows a partial cross section of the Y-tube which corresponds to FIG. 2 for the T-tube.

Figure 11:
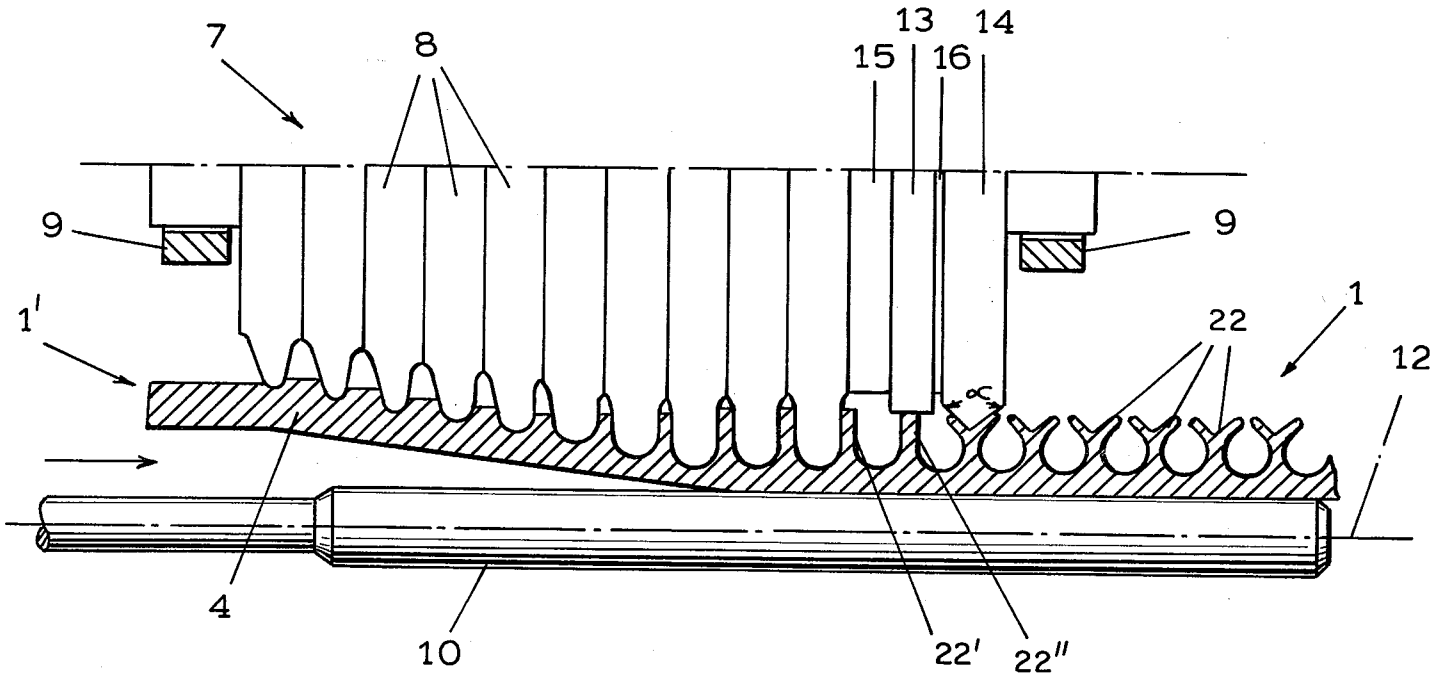
FIG. 11 shows an apparatus for the manufacture of a Y-finned tube based on the FIG. 3 principle.

FIG. 11 shows a device for making a Y-finned tube which, it will be noted, corresponds to the FIG. 3 device for making T-finned tubes except that the flattening roller 11 seen in FIG. 3 is not included in the device of FIG. 11 since no flattening of the Y-fins takes place. Similarly, as was mentioned in conjunction with FIG. 4, where two of the holders 9 would hold notching rollers while the third would hold a flattening roller, in the apparatus of FIG. 11, no flattening roller would be included in the third holder 9 and this third holder could be left without a roller since the two notching rollers would provide the desired Y-form.

FIG. 11, as FIG. 3, shows conventional rolling discs 8, distance roller 15, smoothing roller 13, correction disc 16, and notching roller 14.

All dimensions and procedures in regard to the process and apparatus of FIG. 11 would be the same as those of FIGS. 3 and 4 except, as mentioned, there would be no flattening rollers for flattening the Y-fins into T-fins.

Figure 12:
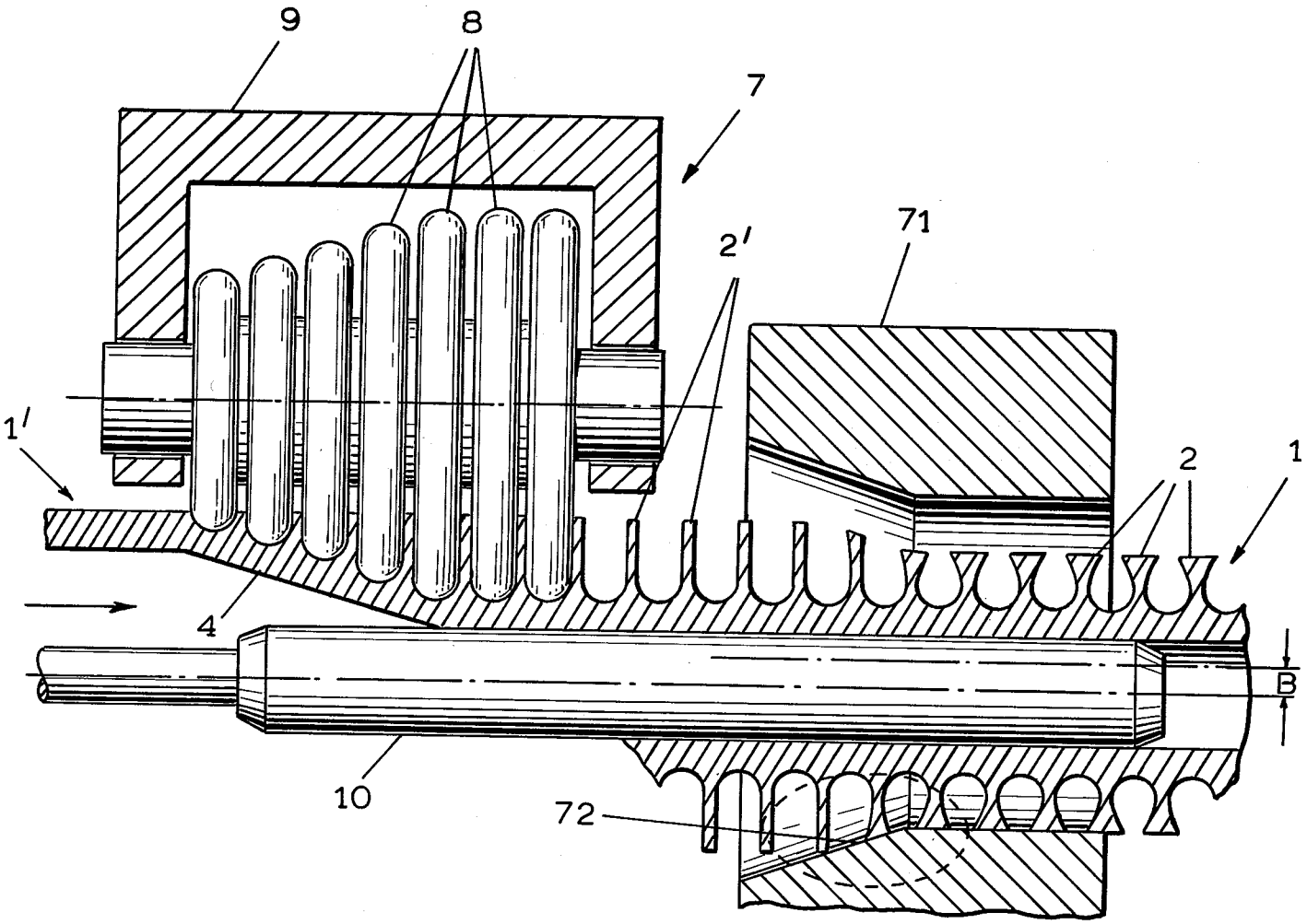
FIG. 12 shows an apparatus for the manufacture of a T-finned tube wherein an eccentrically mounted doughnut shaped hull flattens the fins.

FIG. 12 shows a third embodiment of the invention according to which T-shaped fins are formed by means of a flattening tool operating directly on the fins.

The smooth tube 1' moving in the arrowed direction will be placed in rotation by driven rolling tools 7 located at the circumference of the tube 1', the rolling tools 7 being located at the circumference of the tube in a fixed manner. The rolling tools 7 are indicated only schematically and are adjustable in the radial direction. One could use, for example, 3, 4 or 6 rolling tools 7 constructed of rolling discs 8. As seen in FIG. 12, the rolling discs 8 are arranged in tool holder 9. The rolling tools 7 form, in known fashion, the fins 2' out of the tube wall 4 which is supported by mandrel 10 as was discussed in the case of the embodiment of FIG. 3. There is initially performed in the forward region, a reduction in diameter of the tube 1'. In a middle region of the apparatus, the rolling of the spiral formed circumferentially running fins 2' is performed. As is seen in FIG. 12, flattening tool 71 immediately follows the rolling tools 7. The flattening tool 71 has an axis eccentrically displaced in regard to the rolling axis of the tube 1'. The axis displacement B is shown in FIG. 12. The flattening tool 71 is formed by a stationary hull which has oblique surfaces 72 into which the fins 2' run whereby the fins are flattened to the T-formed fins 2 (see the dashed flattening area in FIG. 12). As seen in FIG. 12, the hull 71 has a generally doughnut shape with the inner surface of the doughnut, 72, performing the flattening function.

Figure 13:
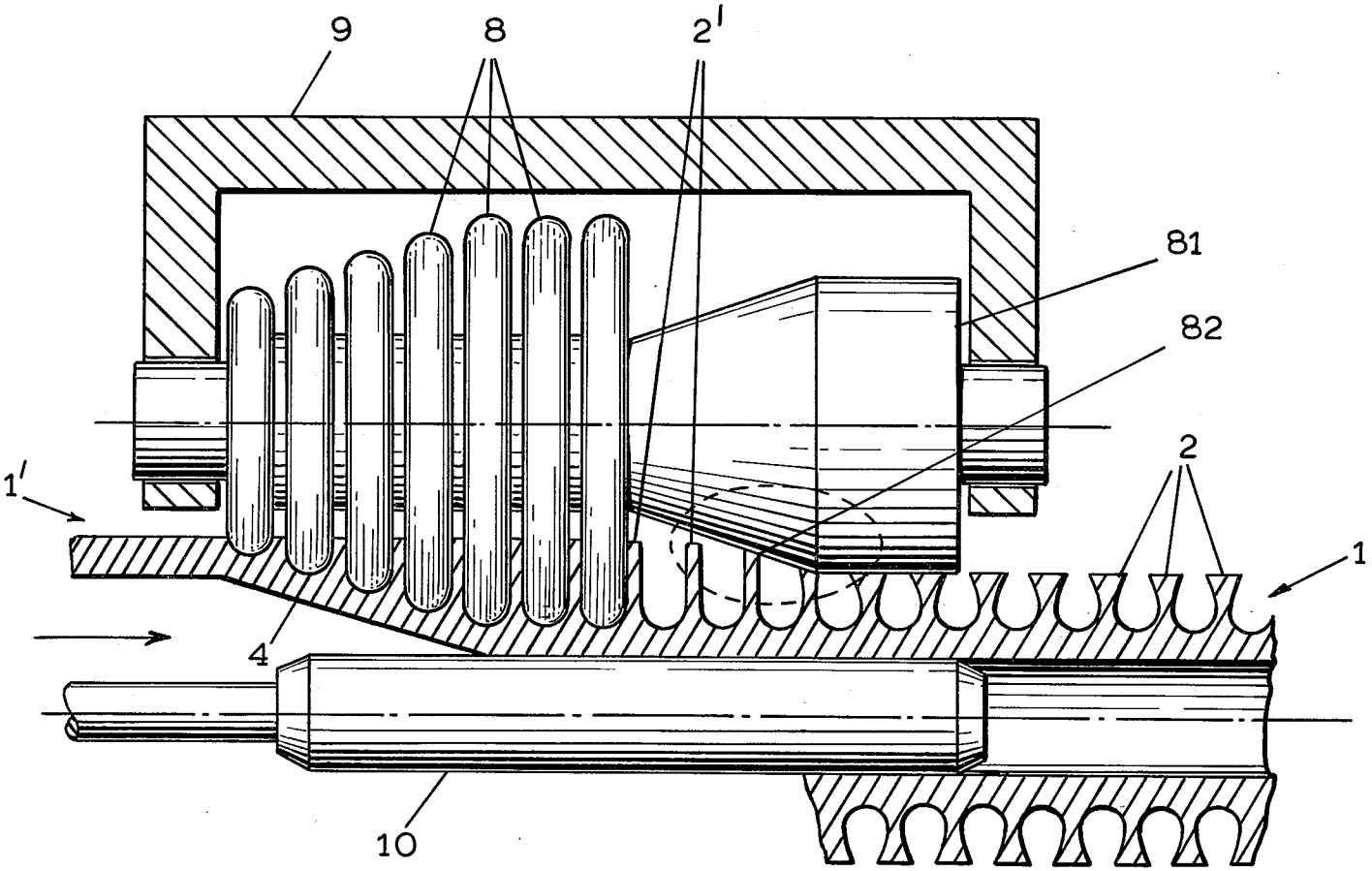
FIG. 13 shows an apparatus for the manufacture of a T-finned tube wherein a conical flattening tool is mounted co-axially with the rolling tool.

The apparatus shown in FIG. 13, can be used with rotating or non-rotating tubes. The rolling tool and the flattening tool 81 are integrated into tool holder 9. The flattening tool 81 is constructed as a smoothing roller which tapers to the rolling discs 8 conically. The diameter of the flattening roller is selected so as to give fins of a desired height. As is the case in regard to FIG. 12, the fins 2', formed by the rolling discs 8, contact the oblique surface 82 of the flattening tool 81 and are flattened to the T-formed fins 2 (the flattening area is shown by the dashed area).

Good heat exchange characteristics can be obtained if one utilizes a finned tube constructed in accordance with FIGS. 12 and 13 having 2 to 20 fins per centimeter and with an upper crevice width of 0.1–1.0 mm.

As an example of dimensions, a smooth tube made of Sf-Cu and having a 19 mm outer diameter and a 1.45 mm wall thickness was used to make a finned tube having 7.5 fins per centimeter, which finned tube was constructed according to the normal process. The tube had an outer diameter of 18.9 mm and a fin height of 1.45 mm. After utilizing the process according to this invention one obtained a T-finned tube having an 18.4 mm outer diameter with T-formed fins having a height of 1.2 mm and a crevice width of 0.3 mm. Such a tube gave an improved performance in regard to the evaporation of R12 on the outer surface of the tube for the following water velocity in the tube: water velocity 2.0 meters per second—improved performance 10%, 2.5 meters per second—20%, 3 meters per second—30%.

Although the apparatus shown in FIGS. 12 and 13 functions in regard to the case where the tube rotates while a rolling head is fixedly mounted in relation to the rotating tube, it is of course possible to adapt the apparatus so that the tube would not rotate and a rolling head would rotate about the tube.

Figure 14:
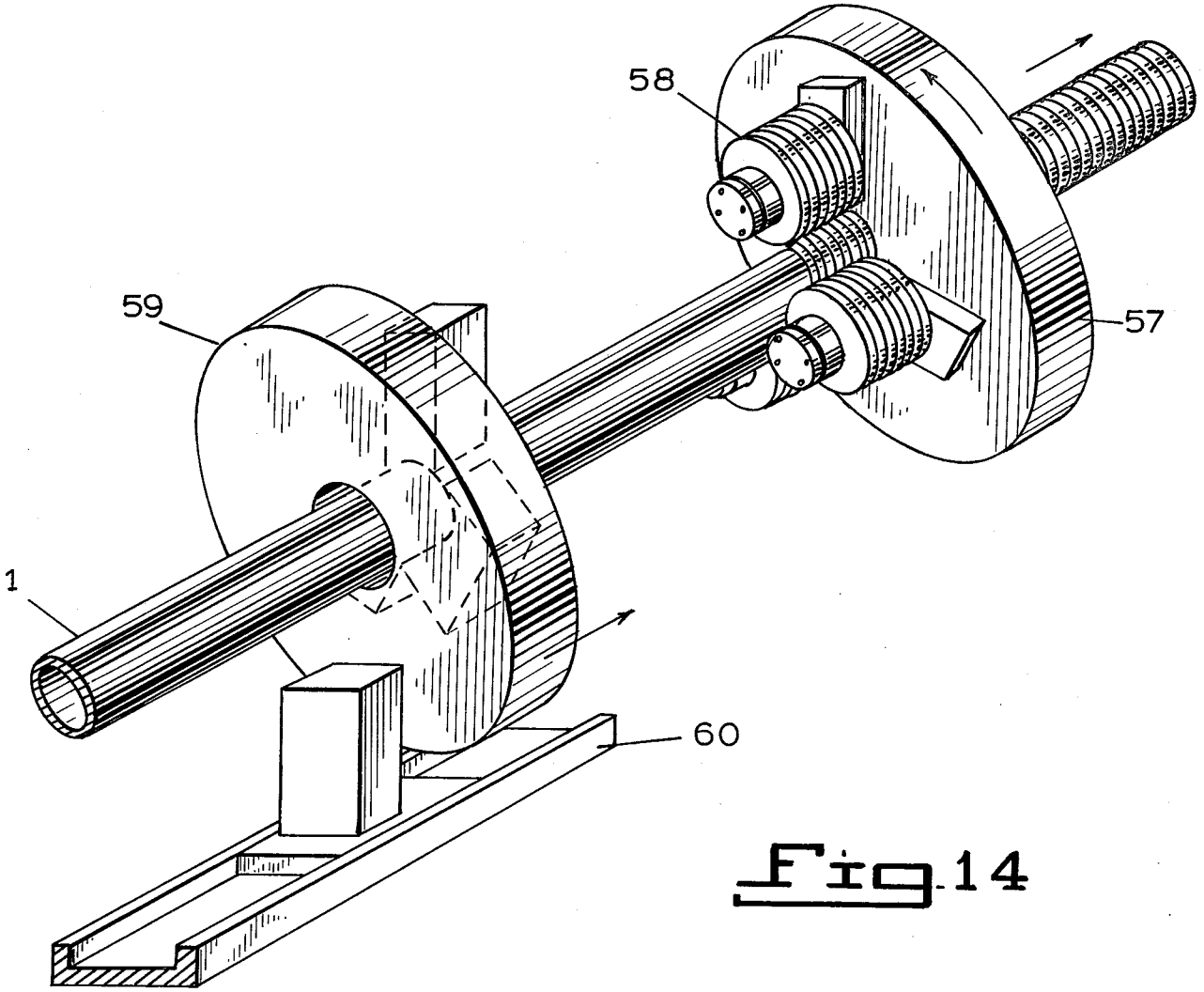
FIG. 14 shows generally a revolving rolling head apparatus with non-rotating tube.

For example, FIG. 14 shows generally the manner in which a rolling head would be constructed with the rolling tools rotating about a non-rotating tube. The tube 1 will be moved in a longitudinal direction as shown by the arrow in the upper right hand corner. Rolling head 57 rotates in the direction shown by the arrow and carries rolling tools 58 which form the fins. The rolling tools 58 are shown only schematically and could be adapted in accordance with the teachings of this invention. The tube 1 does not rotate as it is held in holding clamp 59. Appropriate longitudinal movement is provided by the moving means 60.

Other modifications of the principles of the invention will suggest themselves to those skilled in the art.

We claim:

1. Apparatus for forming fins on a tube outer side, which fins run circumferentially about the tube in a continuous fashion with the outer ends of the fins approaching the outer ends of adjacent fins forming a chamber between adjacent fins, including:

support means for said tube;

rolling disc means for forming a finned tube, said rolling disc means rotating relative to said tube and including a plurality of rolling discs of successively increasing diameters rotatting about an axis of said rolling disc means;

means for notching the upper surface of the formed fins.

2. Apparatus according to claim 1, wherein said notching means includes a notching roller co-axially mounted with said rolling disc means.

3. Apparatus according to claim 2, wherein a smoothing roller means is co-axially mounted between said rolling disc means and said notching roller, said smoothing roller means smoothing the upper surface of the fins formed by said rolling disc means.

4. Apparatus according to claim 3, wherein said smoothing roller is adapted to reduce the height of the fins by 5–15%.

5. Apparatus according to claim 3, wherein a distance disc is co-axially mounted between said smoothing roller and said rolling disc means, the thickness of said distance disc corresponding approximately to one half the fin spacing.

6. Apparatus according to claim 5, wherein a correction disc is co-axially mounted between said notching roller and said smoothing roller.

7. Apparatus for forming fins on a tube outer side, which fins run circumferentially about the tube in a continuous fashion with the outer ends of the fins approaching the outer ends of adjacent fins forming a chamber between adjacent fins, including:

support means for said tube;

rolling disc means for forming a finned tube, said rolling disc means rotating relative to said tube and including a plurality of rolling discs of successively increasing diameters rotating about an axis of said rolling disc means;

means for notching the upper surface of the formed fins, said notching roller means being co-axially mounted with said rolling disc means;

flattening roller means for flattening the upper surface of said formed fins after said upper surface has been notched by said notching roller, said flattening roller being co-axially mounted with said rolling disc.

8. Apparatus according to claim 7, wherein a smoothing roller means is co-axially mounted with said rolling disc means and said notching roller, said smoothing roller means smoothing the upper surface of the fins formed by said rolling disc means.

9. Apparatus according to claim 8, wherein said smoothing roller is adapted to reduce the height of the fins by 5 to 15%.

10. Apparatus according to claim 8, wherein a distance disc is co-axially mounted between said smoothing roller and said rolling disc means, the thickness of said distance disc corresponding to approximately one half of the fin spacing.

11. Apparatus according to claim 10, wherein a correction disc is co-axially mounted between said notching roller and said smoothing roller.

12. Apparatus according to claim 11, wherein said flattening roller means is co-axially mounted with and follows said notching roller.

13. Apparatus for forming fins on a tube outer side, which fins run circumferentially about the tube in a continuous fashion with the outer ends of the fins approaching the outer ends of adjacent fins forming a chamber between adjacent fins including:

a plurality of tool holders arranged at the circumference of the tube in staggered relation to each other;

each tool holder including a plurality of rolling discs;

at least one tool holder including a cylindrical smoothing roller co-axially mounted with the rolling discs;

at least one tool holder including a notching roller co-axially mounted with the rolling discs, said smoothing roller being arranged between said notching roller and said rolling discs.

14. Apparatus according to claim 13, wherein there is provided three tool holders arranged at 120° from each other, at least two of the said tool holders containing said notching rollers.

15. Apparatus according to claim 13, wherein the tube is non-rotatably mounted in a holding clamp.

16. Apparatus according to claim 13, wherein the tube is rotatably mounted.

17. Apparatus for forming fins on a tube outer side, which fins run circumferentially about the tube in a continuous fashion with the outer ends of the fins approaching the outer ends of adjacent fins forming a chamber between adjacent fins including:

a plurality of tool holders arranged at the circumference of the tube in staggered relation to each other;

each tool holder including a plurality of rolling discs;

at least one tool holder including a cylindrical smoothing roller co-axially mounted with the rolling discs;

at least one tool holder including a notching roller co-axially mounted with the rolling discs, said smoothing roller being arranged between said notching roller and said rolling discs;

at least one tool holder including a flattening roller.

18. Apparatus according to claim 17, wherein said flattening roller is arranged subsequent to said notching roller and co-axial therewith.

19. Apparatus according to claim 17, wherein there is provided three tool holders arranged at 120° from each other, at least two of the said tool holders containing said notching roller.

20. Apparatus according to claim 17, wherein the tube is non-rotatably mounted in a holding clamp.

21. Apparatus according to claim 17, wherein the tube is rotatably mounted.

22. An apparatus for constructing a finned tube having generally T-formed fins from a smooth walled tube including:

support means for said tube;

rolling disc means for forming finned tubes, said rolling disc means rotating relative to said tube and including a plurality of rolling discs of successively increasingly diameters rotating about an axis of said rolling disc means;

means for moving the tube in a longitudinal direction;

means for flattening the fins formed by said rolling disc means, said means for flattening including a hull having a first surface at an oblique angle to the surface of the tube and a second surface running generally parallel to the surface of the tube and adjoining said first surface, said first surface being located at the outer circumference of the formed fins, said adjoining surface located radially inwardly of said outer circumference of the formed fins so that the formed fins contact said first surface and are moved against said surface by said means for moving and thereby flattened to the level of said second surface; and wherein said hull is of substantially doughnut form with said tube passing through the central aperture of said hull, the axis of said hull lying parallel to the axis of the tube, but displaced with regard thereto.

23. A process for forming fins on a tube outer side which fins run circumferentially about the tube in a continuous fashion with their outer ends approaching the outer ends of adjacent fins forming a chamber between adjacent fins including the steps of:

displacing the material making up the tube wall in an outward direction by means of a rolling process, said rolling process being carried out by means of rolling discs positioned at the circumference of the tube;

smoothing the formed fins by means of radial pressure by means of a smoothing roller co-axially mounted with said rolling discs;

notching the ends of the smoothed fins in the circumferentially direction of the tube, said notching steps being effected by means of a notching roller co-axially mounted with said smoothing roller and rolling means.

24. A process according to claim 23, including the additional step of flattening said notched fins into a generally T-form, said flattening step being effected by a flattening roller mounted co-axially with said rolling means.

* * * * *